US008968020B2

(12) United States Patent
Nishiyama

(10) Patent No.: US 8,968,020 B2
(45) Date of Patent: Mar. 3, 2015

(54) ELECTRIC CONNECTOR

(71) Applicant: Dai-Ichi Seiko Co., Ltd., Kyoto (JP)

(72) Inventor: Kohei Nishiyama, Tokyo (JP)

(73) Assignee: Dai-Ichi Seiko Co., Ltd., Kyoto (JP)

( * ) Notice: Subject to any disclaimer, the term of this patent is extended or adjusted under 35 U.S.C. 154(b) by 23 days.

(21) Appl. No.: 13/863,652

(22) Filed: Apr. 16, 2013

(65) Prior Publication Data

US 2013/0273765 A1 Oct. 17, 2013

(30) Foreign Application Priority Data

Apr. 17, 2012 (JP) ..... 2012-94094

(51) Int. Cl.

| | |
|---|---|
| ***H01R 12/79*** | (2011.01) |
| ***H01R 13/627*** | (2006.01) |
| ***H01R 12/77*** | (2011.01) |
| *H01R 12/87* | (2011.01) |

(52) U.S. Cl.

CPC ..... *H01R 13/627* (2013.01); *H01R 12/774* (2013.01); *H01R 12/79* (2013.01); *H01R 13/6275* (2013.01); *H01R 12/87* (2013.01)

USPC ..... 439/345

(58) Field of Classification Search

USPC ..... 439/260, 495, 492, 328, 358, 261, 488, 439/350, 345

See application file for complete search history.

(56) References Cited

U.S. PATENT DOCUMENTS

| | | | | |
|---|---|---|---|---|
| 4,531,793 | A | 7/1985 | Hochgesang | |
| 5,242,312 | A | 9/1993 | Tondreault | |
| 6,679,713 | B2 * | 1/2004 | Miura | 439/260 |
| 7,435,122 | B2 * | 10/2008 | Suzuki et al. | 439/260 |
| 7,540,764 | B2 * | 6/2009 | Suzuki et al. | 439/495 |
| 7,563,128 | B2 * | 7/2009 | Suzuki et al. | 439/495 |
| 7,766,680 | B2 * | 8/2010 | Suzuki et al. | 439/260 |
| 7,955,107 | B1 | 6/2011 | Pao et al. | |
| 8,221,147 | B2 * | 7/2012 | Ozeki | 439/260 |
| 8,298,001 | B2 * | 10/2012 | Ashibu et al. | 439/495 |
| 8,337,230 | B1 * | 12/2012 | Kurachi | 439/328 |
| 8,662,915 | B2 * | 3/2014 | Ueda et al. | 439/493 |

(Continued)

FOREIGN PATENT DOCUMENTS

| | | |
|---|---|---|
| EP | 2 251 937 | 11/2010 |
| EP | 2 500 990 | 9/2012 |

(Continued)

OTHER PUBLICATIONS

European Search Report issued Jul. 23, 2013 in European Patent Application No. EP 13 16 3715.

*Primary Examiner* — Alexander Gilman

(74) *Attorney, Agent, or Firm* — Wenderoth, Lind & Ponack, L.L.P.

(57) ABSTRACT

An electric connector includes a housing having a groove configured to receive a signal-transmission medium, and a lock device including a locker configured to lock the signal-transmission medium at the groove, the locker being configured to move up beyond and down below a first inner surface of the groove extending in parallel with a direction in which the signal-transmission medium is received in the groove, the locker being energized towards a second inner surface of the groove, the second inner surface being disposed opposite to the first inner surface, and the lock device further including a compressor configured to compress the signal-transmission medium towards the second inner surface.

20 Claims, 12 Drawing Sheets

(56) References Cited

U.S. PATENT DOCUMENTS

| | | | | |
|---|---|---|---|---|
| 8,678,844 | B2 * | 3/2014 | Yoshisuji et al. | 439/350 |
| 2006/0089045 | A1 * | 4/2006 | Miura et al. | 439/495 |
| 2011/0104936 | A1 * | 5/2011 | Ozeki | 439/488 |
| 2012/0196466 | A1 | 8/2012 | Igarashi et al. | |
| 2012/0238125 | A1 * | 9/2012 | Yoshisuji et al. | 439/350 |

FOREIGN PATENT DOCUMENTS

| | | |
|---|---|---|
| JP | 10-116659 | 5/1998 |
| JP | 2008-153059 | 7/2008 |

* cited by examiner

RELATED ART

ELECTRIC CONNECTOR

BACKGROUND OF THE INVENTION

1. Field of the Invention

The invention relates to an electric connector to be equipped in a circuit board and used for electrically connecting to a signal-transmission medium such as FPC (Flexible Printed Circuit) and FFC (Flexible Flat Cable). The invention further relates to a lock device to be used in an electric connector.

2. Description of the Related Art

FIG. 1 is a cross-sectional view of a conventional electric connector used for electrically connecting to a signal-transmission medium such as FPC and FFC.

As illustrated in FIG. 1, the conventional electric connector 150 includes a housing 153 having a groove 152 into which a signal-transmission medium 151 such as FPC and FFC is inserted at opposite edges thereof, and a lock device 154 including a lock 154*a* for locking the signal-transmission medium 151 at the groove 152 and allowing the signal-transmission medium 151 to be released out of the groove 152. The locker 154*a* is designed to move up beyond and move down below a lower inner surface 152*a* of the groove 152.

The lock device 154 is formed of an elastic material. The locker 154*a* is energized towards an upper inner surface 152*b* facing the lower inner surface 152*a*.

The signal-transmission medium 151 is formed at each of side edges thereof with a cut-out 151*a*. Inserting the signal-transmission medium 151 into the groove 152 in a direction indicated with an arrow X, the signal-transmission medium 151 makes contact at a lower surface 151*b* thereof with the locker 154*a*, and pushes the locker 154*a* down. When the cut-out 151*a* reaches a position above the locker 154*a*, the locker 154*a* moves up by virtue of an elastic force of the lock device 154 to thereby fit into the cut-out 151*a*. Thus, the signal-transmission medium 151 is fixed in the groove 152.

There have been suggested various electric connectors apart from the above-mentioned electric connector 150. As a conventional electric connector related to the electric connector in accordance with the present invention, Japanese Patent Application Publication No. 2008-153059 has suggested "a connector", for instance.

As illustrated in FIG. 1, in the conventional electric connector 150, the locker 154*a* upwardly protrudes beyond the lower inner surface 152*a* of the groove 152 by a height necessary for engaging to the cut-out 151*a*. Consequently, if a thickness 151*t* of the signal-transmission medium 151 inserted into the groove 152 is smaller than a distance 152*c* between the lower inner surface 152*a* and the upper inner surface 152*b* of the groove 152, there is generated a space G between the signal-transmission medium 151 and the upper inner surface 152*b* of the groove 152. Thus, if the signal-transmission medium 151 moves upwardly, a length by which the locker 154*a* is engaged to the cut-out 151*a* of the signal-transmission medium 151 is reduced. Such a length varies in dependence on a variance of the thickness 151*t* of the signal-transmission medium 151. Accordingly, if such a length were small, the locker 154*a* makes unstable engagement with the cut-out 151*a*, resulting in reduction in contact reliability between the electric connector 150 and the signal-transmission medium 151.

Though the "connector" suggested in the above-identified Publication is designed to have a countermeasure for avoiding the reduction in contact reliability, the reduction in contact reliability in the conventional electric connector 150 illustrated in FIG. 1 cannot be prevented by the above-identified Publication.

SUMMARY OF THE INVENTION

In view of the above-mentioned problem in the conventional electric connector, it is an object of the present invention to provide an electric connector capable of presenting highly reliable electric connection between an electric connector and a signal-transmission medium, even if there were a variance in a thickness of the signal-transmission medium.

In one aspect of the present invention, there is provided an electric connector including a housing having a groove into which a signal-transmission medium is inserted at opposite edges thereof, and a lock device including a locker for locking the signal-transmission medium at the groove and allowing the signal-transmission medium to be released out of the groove, the locker moving up beyond and moving down below a first inner surface of the groove extending in parallel with a direction in which the signal-transmission medium is inserted into the groove, the locker being energized towards a second inner surface of the groove situated opposing to the first inner surface, the lock device further including a compressor for compressing the signal-transmission medium towards the second inner surface so as to allow the signal-transmission medium to be released out of the groove.

In the electric connector in accordance with the present invention, when a signal-transmission medium having been inserted into the groove of the housing is fixed by means of the locker, the compressor of the lock device compresses the signal-transmission medium towards the second inner surface, ensuring that no gap is formed between the signal-transmission medium and the second inner surface of the groove, and hence, a length by which the locker is engaged to a cut-out of the signal-transmission medium can be constant. Thus, even if there were a variance in a thickness of a signal-transmission medium, highly reliable electric connection can be presented between an electric connector and a signal-transmission medium.

It is preferable that the compressor is located between a top surface of the locker and the first inner surface. Herein, "a top surface" of the locker indicates a surface located closet to the second inner surface facing the first inner surface in the lock device designed to be able to move up beyond and move down below the first inner surface of the groove.

By so designing the compressor, even if a thickness of a signal-transmission medium inserted into the groove had a variance within a distance between the first and second inner surfaces of the groove, reliable electric connection can be surely presented between an electric connector and a signal-transmission medium.

For instance, the compressor may be designed to comprise a flat surface.

It is preferable that the lock device further includes a releaser for, when compressed, causing the lock device to be elastically deformed to thereby cause the locker to be released from the signal-transmission medium.

By so designing the lock device, the lock device has functions of locking a signal-transmission medium in the electric connector and unlocking a signal-transmission medium out of the electric connector, ensuring that both the function of locking a signal-transmission medium in the electric connector and the function of unlocking a signal-transmission medium out of the electric connector can be presented without increasing a number of parts.

It is preferable that the lock device is made of a single plate having elasticity.

It is preferable that the lock device includes a base, and a lock arm being J-shaped relative to the base, wherein the locker is located at a distal end of the lock arm and is substantially wedge-shaped, and the compressor is formed adjacent to the locker.

It is preferable that the lock device includes a base, and a lock arm being J-shaped relative to the base, wherein the locker is located at a distal end of the lock arm and is substantially wedge-shaped, the compressor is formed adjacent to the locker, and the releaser is formed in facing relation with the locker.

By so designing the lock device, it is possible to provide a function of surely locking a signal-transmission medium and a function of compressing the same regardless of a simple structure of the lock device, ensuring enhanced contact reliability between the electric connector and a signal-transmission medium.

In another aspect of the present invention, there is provided a lock device housed in a housing of an electric connector, the housing having a groove into which a signal-transmission medium is inserted at opposite edges thereof, the lock device including a locker for locking the signal-transmission medium at the groove and allowing the signal-transmission medium to be released out of the groove, the locker moving up beyond and moving down below a first inner surface of the groove extending in parallel with a direction in which the signal-transmission medium is inserted into the groove, the locker being energized towards a second inner surface of the groove situated opposing to the first inner surface, the lock device further including a compressor for compressing the signal-transmission medium towards the second inner surface so as to allow the signal-transmission medium to be released out of the groove.

In the lock device in accordance with the present invention, it is preferable that the compressor is located between a top surface of the locker and the first inner surface.

In the lock device in accordance with the present invention, it is preferable that the compressor comprises a flat surface.

In the lock device in accordance with the present invention, it is preferable that the lock device further includes a releaser for, when compressed, causing the lock device to be elastically deformed to thereby cause the locker to be released from the signal-transmission medium.

In the lock device in accordance with the present invention, it is preferable that the lock device is made of a single plate having elasticity.

In the lock device in accordance with the present invention, it is preferable that the lock device includes a base, and a lock arm being J-shaped relative to the base, wherein the locker is located at a distal end of the lock arm and is substantially wedge-shaped, and the compressor is formed adjacent to the locker.

In the lock device in accordance with the present invention, it is preferable that the lock device includes a base, and a lock arm being J-shaped relative to the base, wherein the locker is located at a distal end of the lock arm and is substantially wedge-shaped, the compressor is formed adjacent to the locker, and the releaser is formed in facing relation with the locker.

The advantages obtained by the aforementioned present invention will be described hereinbelow.

The electric connector in accordance with the present invention is capable of presenting highly reliable electric connection between itself and a signal-transmission medium, even if there were a variance in a thickness of a signal-transmission medium.

The above and other objects and advantageous features of the present invention will be made apparent from the following description made with reference to the accompanying drawings, in which like reference characters designate the same or similar parts throughout the drawings.

DESCRIPTION OF THE PREFERRED EMBODIMENTS

Figure 1:
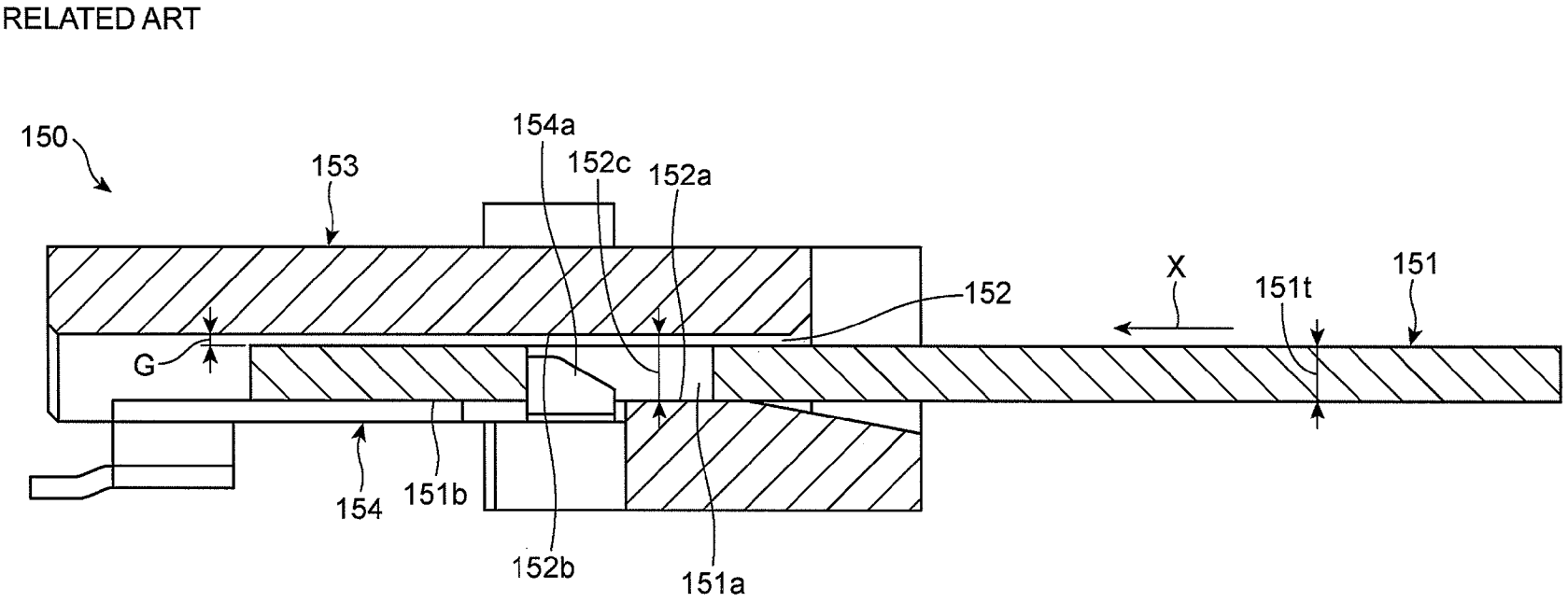
FIG. 1 is a cross-sectional view of the conventional electric connector into which a signal-transmission medium is inserted.
Figure 2:
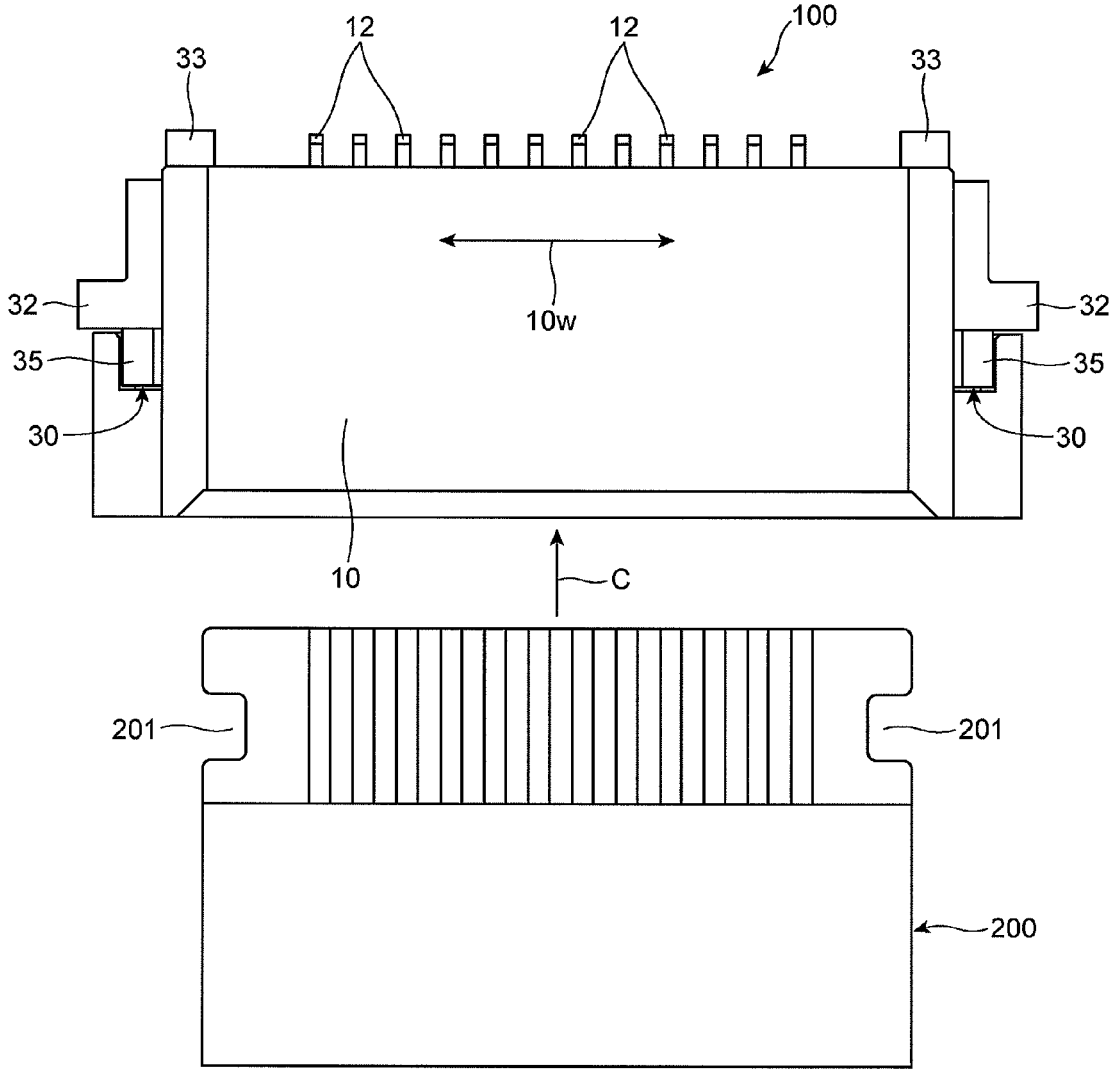
FIG. 2 is a plan view of the electric connector in accordance with the embodiment of the present invention and a signal-transmission medium.

The electric connector in accordance with the preferred embodiment of the present invention is described hereinbelow with reference to FIGS. 2 to 15.

As illustrated in FIGS. 2 to 6, the electric connector 100 in accordance with the preferred embodiment of the present invention includes an electrically insulative housing 10 having a groove 11 into which a signal-transmission medium 200 is inserted at opposite edges thereof, and a lock device 30 including a locker 31 for locking the signal-transmission medium 200 at the groove 11 and allowing the signal-transmission medium 200 to be released out of the groove 11. The locker 31 is designed to move up beyond and move down below a lower inner surface 11*a* of the groove 11 extending in parallel with a direction C in which the signal-transmission 200 is inserted into the groove 11, and is energized towards an upper inner surface 11*b* of the groove 11 situated facing the lower inner surface 11*a*. The lock device 30 further includes a compressor 34 for compressing the signal-transmission medium 200 towards the upper inner surface 11*b* when the signal-transmission medium 200, having been inserted into the groove 11, is locked by the locker 31.

Figure 3:
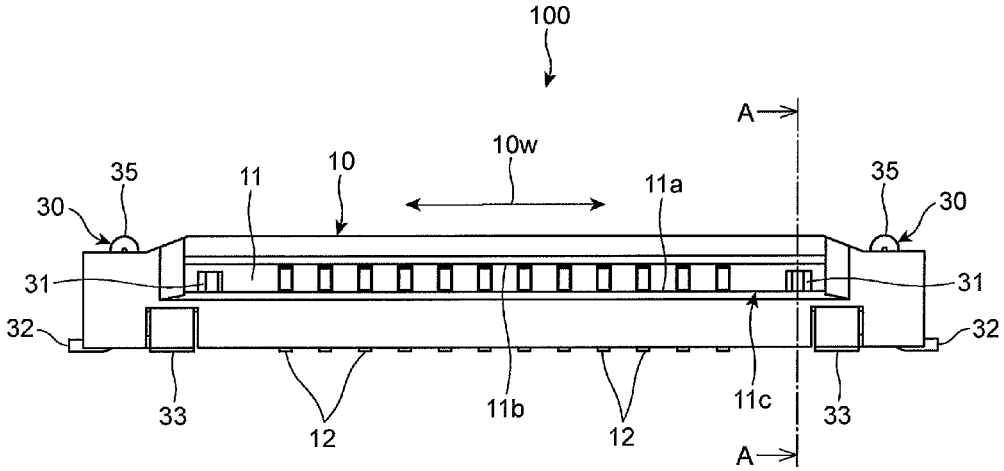
FIG. 3 is a front view of the electric connector illustrated in FIG. 2.
Figure 4:
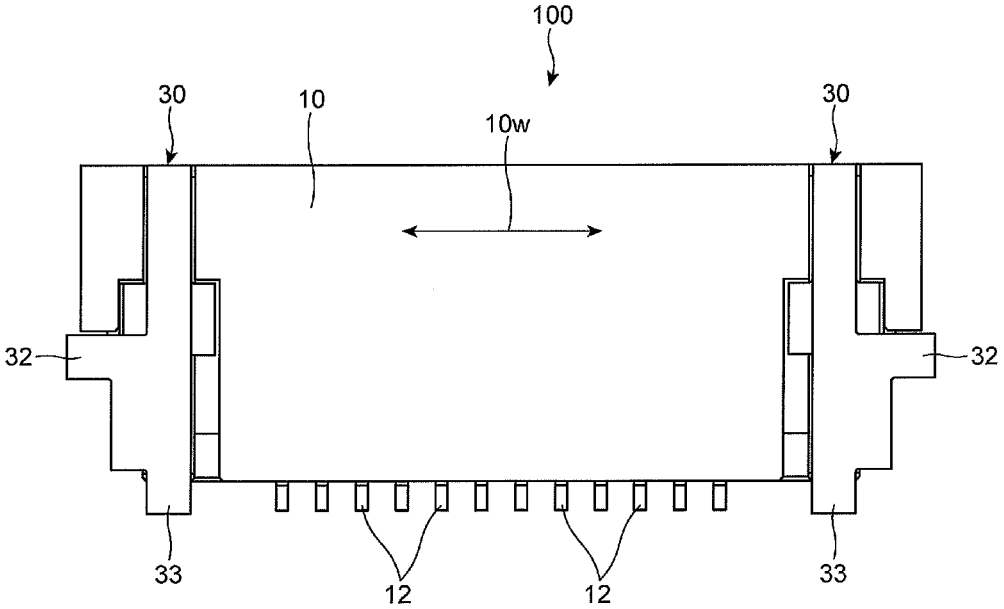
FIG. 4 is a bottom view of the electric connector illustrated in FIG. 2.
Figure 5:
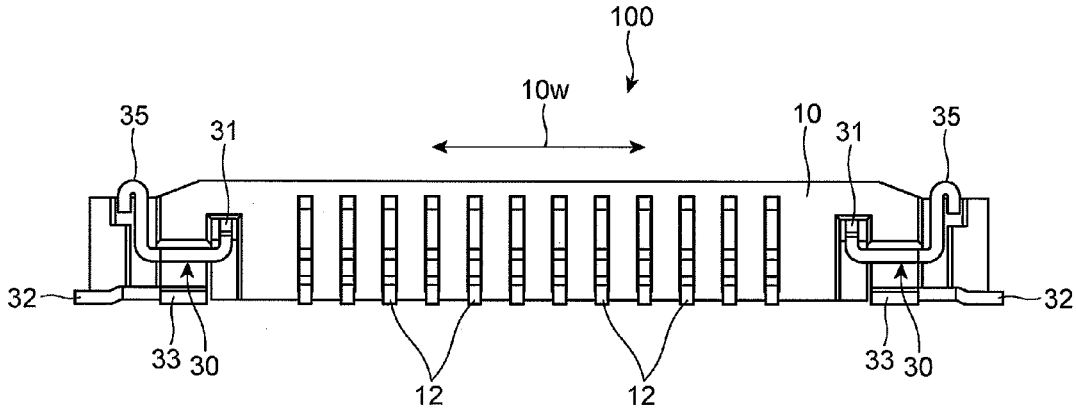
FIG. 5 is a rear view of the electric connector illustrated in FIG. 2.

The electrically insulative housing 10 has a plurality of contacts 12 equally spaced away from adjacent ones. Grounded portions 32 and 33 formed integral with the lock device 30 are located in the vicinity of opposite side edges of the electrically insulative housing 10 in a width-wise direction 10*w* of the housing 10. As mentioned later, the lock device 30 is integrally formed with a pair of releasers 35 which, when compressed, cause the lock device 30 to be elastically deformed to thereby cause the locker 31 to be released from the signal-transmission medium 200. As illustrated in FIG. 3, the releasers 35 upwardly protrude beyond an upper surface of the electrically insulative housing 10 in the vicinity of opposite side edges of the electrically insulative housing 10 in a width-wise direction 10*w* of the electrically insulative housing 10.

Figure 6:
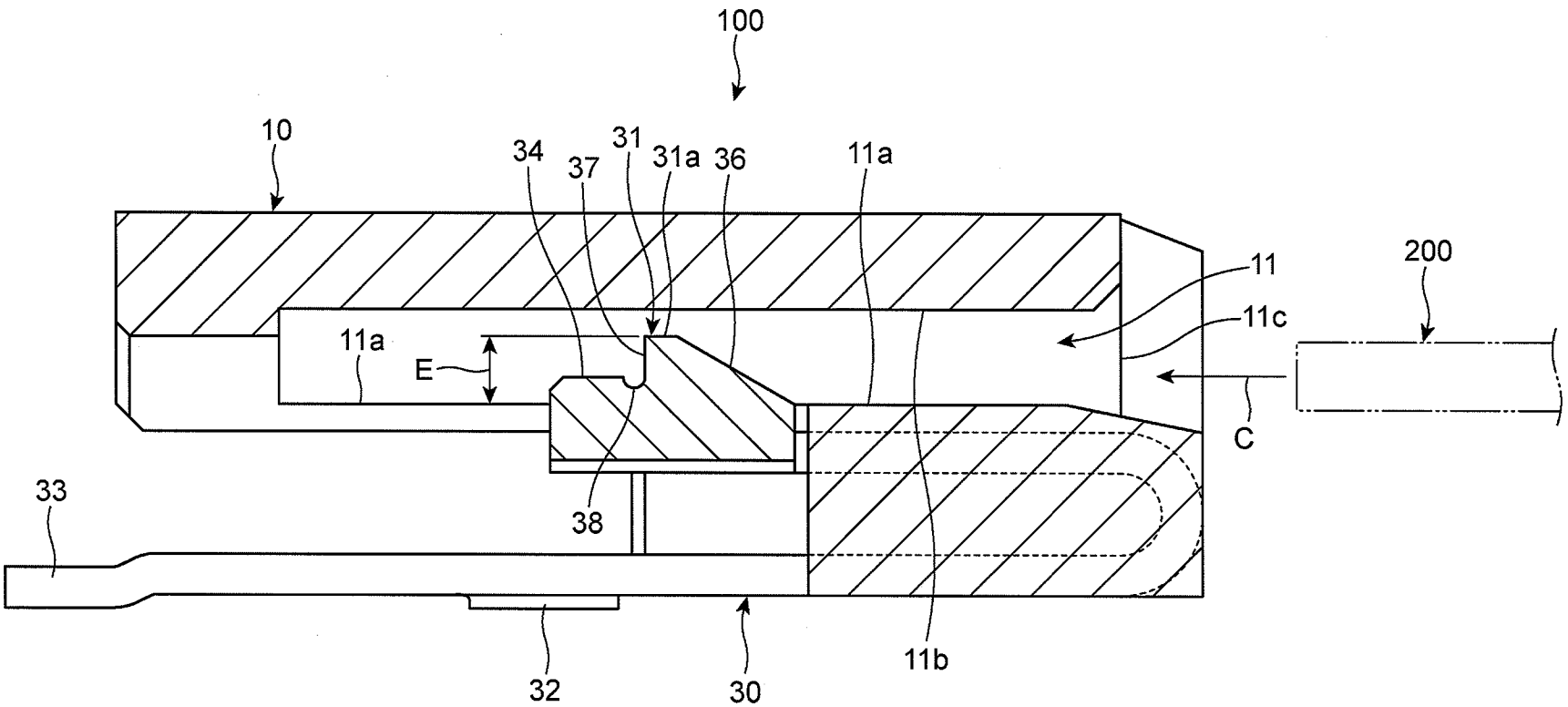
FIG. 6 is an enlarged cross-sectional view taken along the line A-A shown in FIG. 3.

As illustrated in FIG. 6, the compressor 34, which is in the form of a flat surface, is located within an area E defined between a top surface 31*a* of the locker 31 and the lower inner surface 11*a* of the groove 11. Specifically, the compressor 34 is located in the area E having a height lower than the top surface 31*a* of the locker 31, and higher than the lower inner surface 11*a* of the groove 11. Herein, the top surface 31*a* of the locker 31 indicates a surface located closet closest to the upper inner surface 11*b* of the groove 11.

The top surface 31*a* of the locker 31 is in the form of a flat surface. The locker 31 has an inclined surface 36 facing an opening 11*c* of the groove 11, and ascending along a direction C in which the signal-transmission medium 200 is inserted into the groove 11. The locker 31 further has a vertical wall 37 between the top surface 31*a* and the compressor 34. At a boundary between the vertical wall 37 and the compressor 34 is formed a recess 38 below the compressor 34. A length-wise direction of the recess 38 is perpendicular to a direction C in which the signal-transmission medium 200 is inserted into the groove 11, and is in parallel with a length-wise direction of the groove 11.

Figure 7:
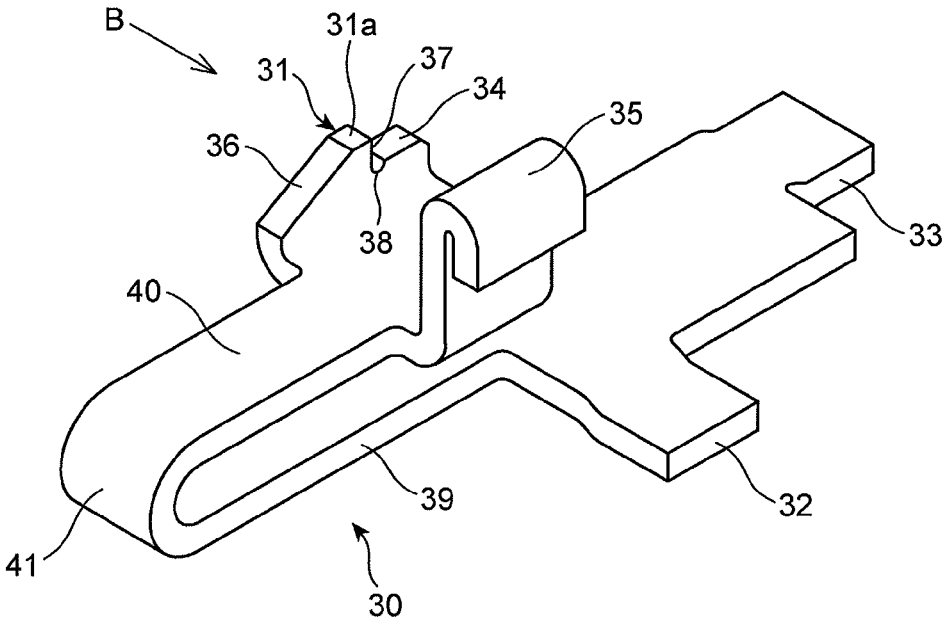
FIG. 7 is a perspective view of the lock device, a part of the electric connector illustrated in FIG. 2.
Figure 8:
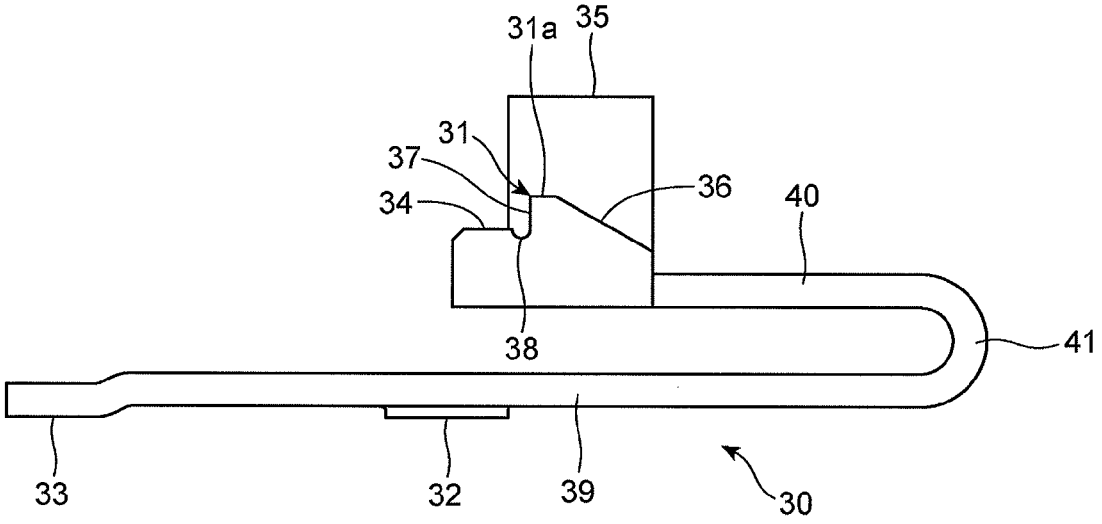
FIG. 8 is a side view viewing in a direction indicated with an arrow B shown in FIG. 7.
Figure 9:
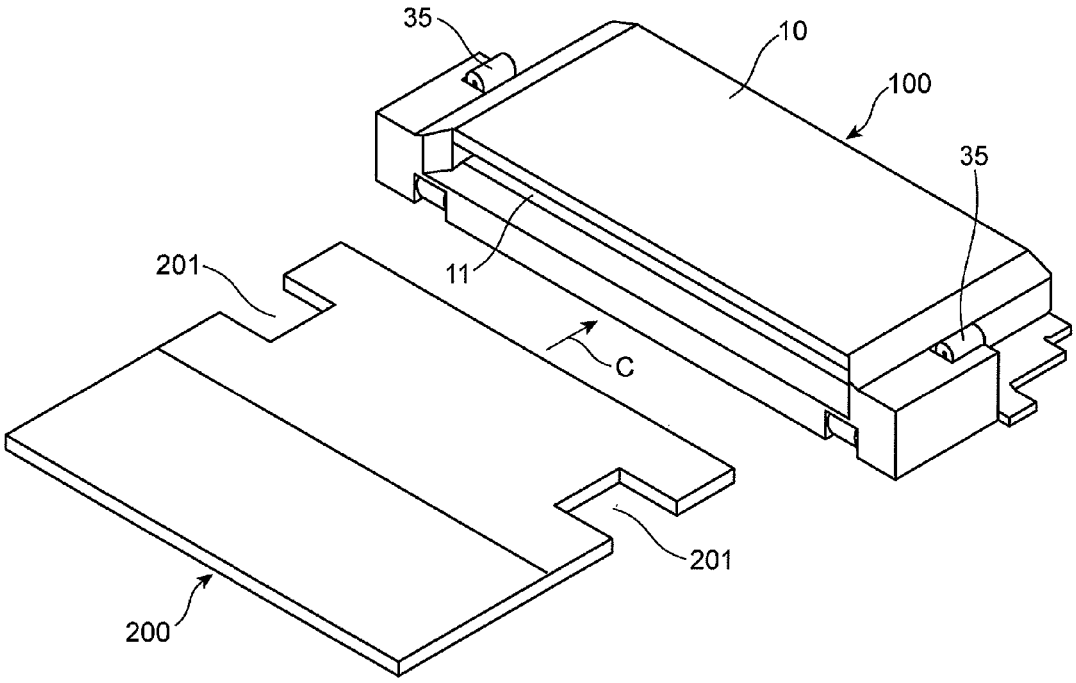
FIG. 9 is a perspective view of the electric connector and the signal-transmission medium both illustrated in FIG. 2.
Figure 10:
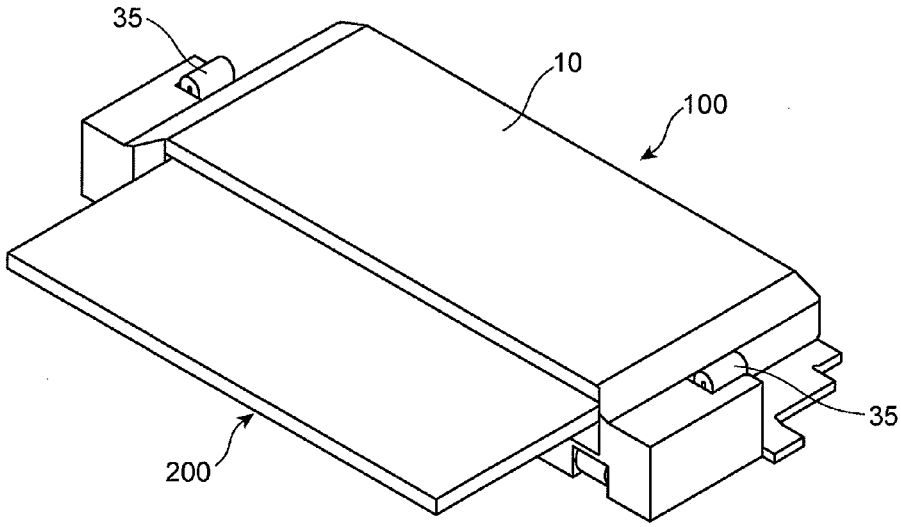
FIG. 10 is a perspective view of the electric connector and the signal-transmission medium both connected to each other and both illustrated in FIG. 9.
Figure 11:
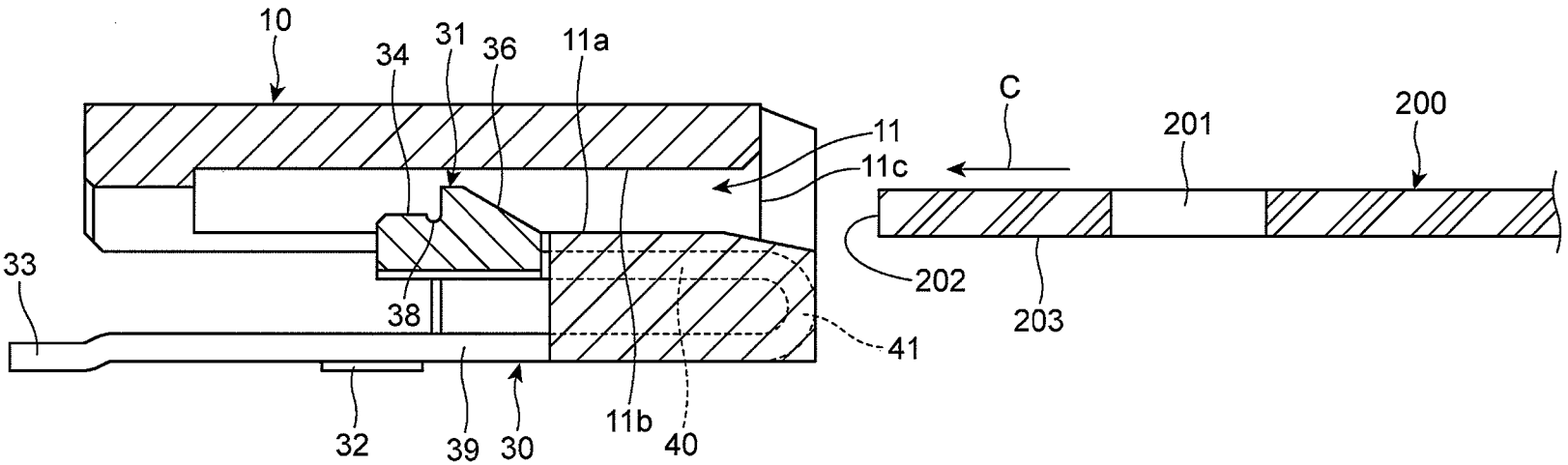
FIG. 11 is a cross-sectional view of the electric connector and the signal-transmission medium both in the condition illustrated in FIG. 9.

As illustrated in FIGS. 7 and 8, the lock device 30 can be fabricated by bending a strip-shaped metal plate having elasticity. The lock device 30 includes a base 39, and a lock arm 40 being J-shaped relative to the base 39. The base 39 and the lock arm 40 are connected to each other through a U-shaped elastic portion 41. The locker 31 is located at a distal end of lock arm 40, and is substantially wedge-shaped. The compressor 34 is formed adjacent to the locker 31.

The releaser 35 is formed in facing relation with the locker 31 and the compressor 34 in a width-wise direction of the lock arm 40. The lock arm 40 is substantially in the form of a strip. Each of the locker 31, the compressor 34 and the releaser 35 is formed like a rib by vertically bending portions extending in a width-wise direction of the lock arm 40 from opposite side edges of the lock arm 40 in the vicinity of a distal end of the lock arm 40. The releaser 35 is formed by bending the portion to be rounded or J-shaped at a top.

Figure 12:
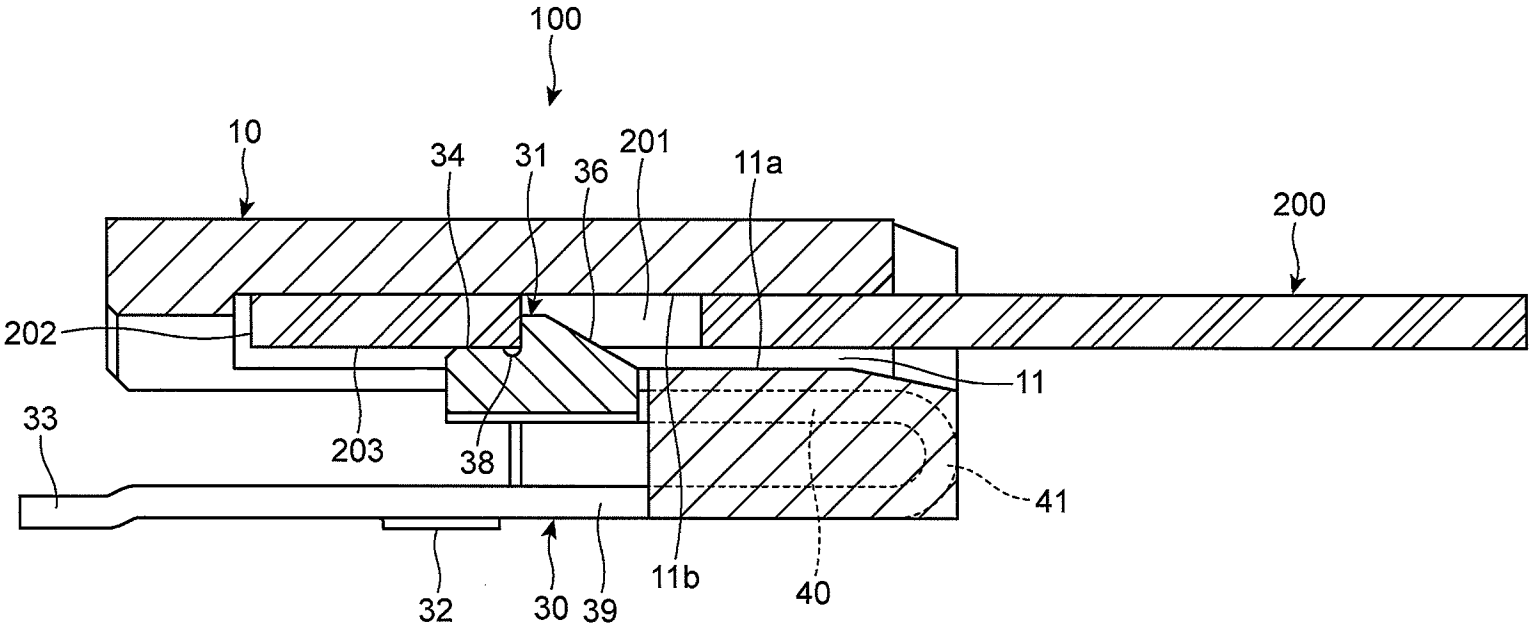
FIG. 12 is a cross-sectional view of the electric connector and the signal-transmission medium both in the condition illustrated in FIG. 1.

As illustrated in FIGS. 9 to 12, inserting the signal-transmission medium 200 formed at opposite side edges thereof with cut-outs 201, into the groove 11 of the electric connector 100 in the direction C, the signal-transmission medium 200 makes contact at a lower surface 203 of a front 202 thereof with the inclined surface 36 of the locker 31, and moves further into the groove 11, downwardly pushing the locker 31. When each of the cut-outs 201 arrives above the locker 31, the locker 31 moves upwardly by virtue of an elastic force of the lock device 30, as illustrated in FIG. 12, and thus, is fit into the cut-out 201. Thus, the signal-transmission medium 200 is fixed in the groove 11.

As illustrated in FIG. 12, while the signal-transmission medium 200 having been inserted into the groove 11 of the housing 10 is being locked by the locker 31, the compressor 34 of the lock device 30 makes contact with the lower surface 203 of the signal-transmission medium 200 to thereby compress the signal-transmission medium 200 towards the upper inner surface 11*b* of the groove 11. Thus, no gap is formed between the signal-transmission medium 200 and the upper inner surface 11*b* of the groove 11, and hence, a length by which the locker 31 is engaged to the cut-out 201 of the signal-transmission medium 200 can be constant, ensuring that highly reliable electric connection can be presented between the electric connector 100 and the signal-transmission medium 200.

Figure 13:
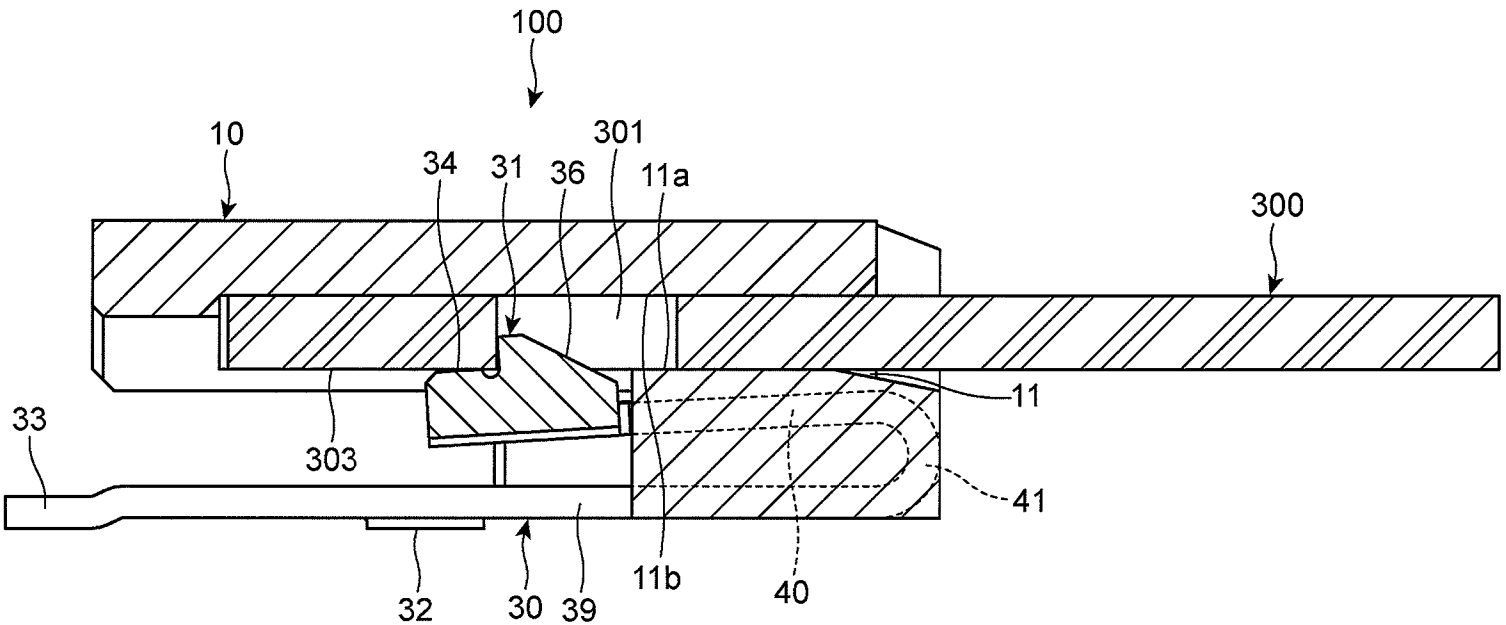
FIG. 13 is a cross-sectional view of the electric connector illustrated in FIG. 6 to which another signal-transmission medium is connected.

As illustrated in FIG. 13, in the case that a signal-transmission medium 300 having a thickness greater than the same of the signal-transmission medium 200 is inserted into the groove 11, the locker 31 is located closer to the base 39 than the case illustrated in FIG. 12. Since the compressor 34 makes contact with a lower surface 303 of the signal-transmission medium 300 and compresses the signal-transmission medium 300 towards the upper inner surface 11*b* by virtue of the elastic force of the locker 31, no gap is formed between the signal-transmission medium 300 and the upper inner surface 11*b* of the groove 11, ensuring that a length by which the locker 31 is engaged to a cut-out 301 of the signal-transmission medium 300 can be constant, and highly reliable electric connection can be presented between the electric connector 100 and the signal-transmission medium 300.

Accordingly, even if there were a variance in a thickness of the signal-transmission medium 200 or 300, highly reliable electric connection can be presented between the electric connector 100 and the signal-transmission medium 200, 300. That is, even if a thickness of the signal-transmission medium 200, 300 inserted into the groove 11 had a variance within a distance between the lower and upper inner surfaces 11*a*, 11*b* of the groove 11, reliable electric connection can be surely presented between the electric connector 100 and the signal-transmission medium 200, 300.

Figure 14:
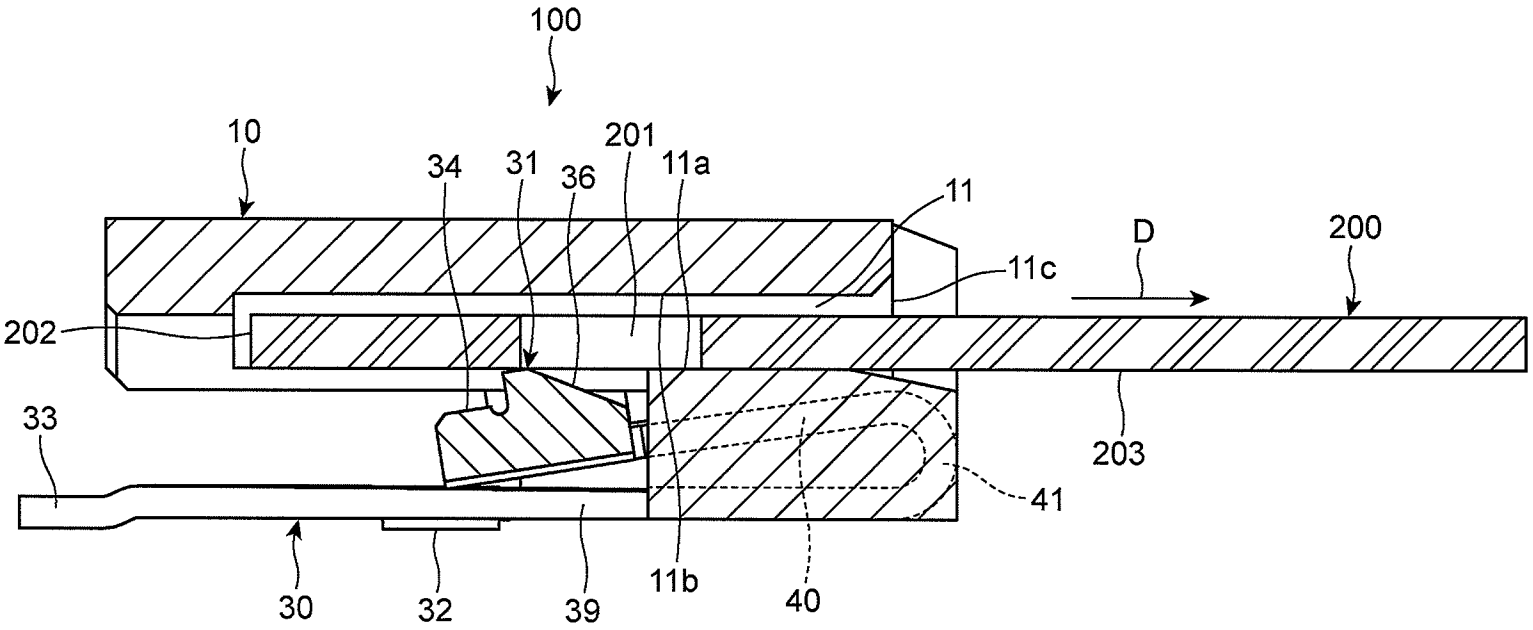
FIG. 14 is a cross-sectional view of the electric connector and the signal-transmission medium both illustrated in FIG. 12, the signal-transmission medium being unlocked from the electric connector.
Figure 15:
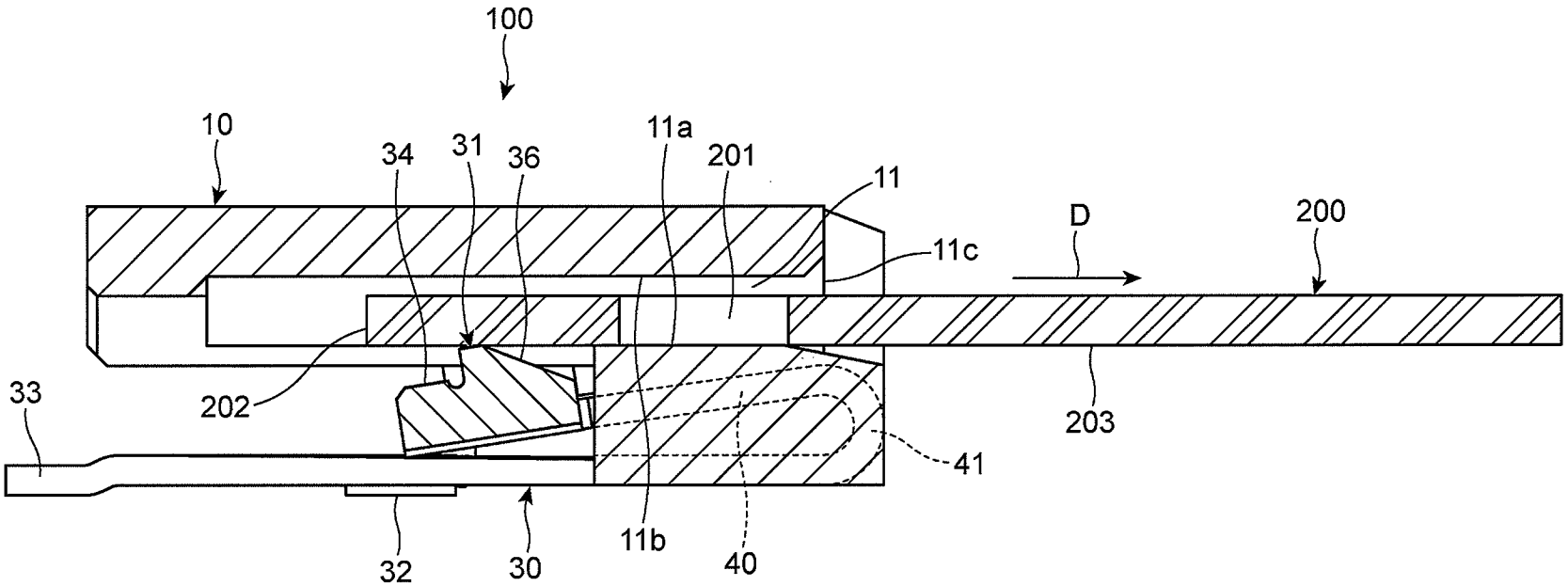
FIG. 15 is a cross-sectional view of the electric connector and the signal-transmission medium both illustrated in FIG. 14, the signal-transmission being taken out of the electric connector.

When the signal-transmission medium 200 having been inserted into the electric connector 100 is to be taken out of the electric connector 100, the releasers 35 (see FIG. 10) protruding beyond an upper surface of the electrically insulative housing 10 in the vicinity of the opposite side edges of the electrically insulative housing 10 are compressed. Thus, as illustrated in FIG. 14, the locker 31 are caused to downwardly move together with the lock arm 40, and accordingly, the locker 31 is released out of the cut-out 201 of the signal-transmission medium 200. Then, by pulling the signal-transmission medium 200 in a direction indicated with an arrow D, as illustrated in FIG. 15, the signal-transmission medium 200 can be gradually taken out of the groove 11.

INDUSTRIAL APPLICABILITY

The electric connector in accordance with the present invention can be broadly employed, for instance, in fields of electric/electronic industry and automobile industry as an electric connector for electrically connecting a signal-transmission medium such as FPC and FFC to a circuit board.

While the present invention has been described in connection with the certain preferred embodiment with reference to FIGS. 2 to 15, it is to be understood that the subject matter encompassed by way of the present invention is not to be limited to those specific embodiment. On the contrary, it is intended for the subject matter of the invention to include all alternatives, modifications and equivalents as can be included within the spirit and scope of the following claims.

The entire disclosure of Japanese Patent Application No. 2012-94094 filed on Apr. 17, 2012 including specification, claims, drawings and summary is incorporated herein by reference in its entirety.

What is claimed is:

1. An electric connector comprising:

a housing having a groove configured to receive a signal-transmission medium; and a lock device including a locker configured to lock said signal-transmission medium at said groove and allow said signal-transmission medium to be released out of said groove, wherein:

said locker is configured to move up beyond and down below a first inner surface of said groove, said first inner surface extending in parallel with a direction in which said signal-transmission medium is received in said groove, said locker is energized towards a second inner surface of said groove, said second inner surface being disposed opposite to said first inner surface, said lock device further includes a compressor configured to compress said signal-transmission medium towards said second inner surface, and said compressor extends away from said locker in a same longitudinal direction in which a top surface of said locker extends, and said compressor is located between said top surface of said locker and said first inner surface.

2. The electric connector as set forth in claim 1, wherein said compressor comprises a flat surface.

3. The electric connector as set forth in claim 1, wherein said lock device further includes a releaser configured to cause said lock device to be elastically deformed and thereby cause said locker to be released from said signal-transmission medium when said releaser is compressed.

4. The electric connector as set forth in claim 3, wherein said lock device is made of a single plate having elasticity.

5. The electric connector as set forth in claim 4, wherein said lock device includes:

a base; and a lock arm being J-shaped relative to said base;

wherein said locker is located at a distal end of said lock arm and is substantially wedge-shaped, wherein said compressor is formed adjacent to said locker, and wherein said releaser is formed in facing relation with said locker.

6. The electric connector as set forth in claim 1, wherein said lock device is made of a single plate having elasticity.

7. The electric connector as set forth in claim 6, wherein said lock device includes:

a base; and a lock arm being J-shaped relative to said base;

wherein said locker is located at a distal end of said lock arm and is substantially wedge-shaped, and wherein said compressor is formed adjacent to said locker.

8. The electric connector as set forth in claim 1, wherein said same longitudinal direction is said direction in which said signal-transmission medium is received in said groove.

9. The electric connector as set forth in claim 1, wherein said compressor is parallel to said top surface of said locker.

10. The electric connector as set forth in claim 1, wherein a recess is formed between said compressor and said locker.

11. A lock device housed in a housing of an electric connector, said housing having a groove configured to receive a signal-transmission medium, wherein:

said lock device includes a locker configured to lock said signal-transmission medium at said groove and allow said signal-transmission medium to be released out of said groove, said locker is configured to move up beyond and down below a first inner surface of said groove, said first inner surface extending in parallel with a direction in which said signal-transmission medium is received in said groove, said locker is energized towards a second inner surface of said groove, said second inner surface being disposed opposite to said first inner surface, said lock device further includes a compressor configured to compress said signal-transmission medium towards said second inner surface, and said compressor extends away from said locker in a same longitudinal direction in which a top surface of said locker extends, and said compressor is located between said top surface of said locker and said first inner surface.

12. The lock device as set forth in claim 11, wherein said compressor comprises a flat surface.

13. The lock device as set forth in claim 11, wherein said lock device further includes a releaser configured to cause said lock device to be elastically deformed and thereby cause said locker to be released from said signal-transmission medium when said releaser is compressed.

14. The lock device as set forth in claim 13, wherein said lock device is made of a single plate having elasticity.

15. The lock device as set forth in claim 14, wherein said lock device includes:

a base; and a lock arm being J-shaped relative to said base;

wherein said locker is located at a distal end of said lock arm and is substantially wedge-shaped, wherein said compressor is formed adjacent to said locker, and wherein said releaser is formed in facing relation with said locker.

16. The lock device as set forth in claim 11, wherein said lock device is made of a single plate having elasticity.

17. The lock device as set forth in claim 16, wherein said lock device includes:

a base; and a lock arm being J-shaped relative to said base;

wherein said locker is located at a distal end of said lock arm and is substantially wedge-shaped, and wherein said compressor is formed adjacent to said locker.

18. The lock device as set forth in claim 11, wherein said same longitudinal direction is said direction in which said signal-transmission medium is received in said groove.

19. The lock device as set forth in claim 11, wherein said compressor is parallel to said top surface of said locker.

20. The lock device as set forth in claim 11, wherein a recess is formed between said compressor and said locker.

* * * * *